US005349805A

United States Patent [19]

Brown

[11] Patent Number: 5,349,805

[45] Date of Patent: Sep. 27, 1994

[54] BREASTPLATE ASSEMBLY WITH ELASTIC TIEDOWN

[75] Inventor: Roy L. Brown, Nevada, Mo.

[73] Assignee: Ortho-Flex Saddle Co., Inc., Nevada, Mo.

[21] Appl. No.: 181,781

[22] Filed: Jan. 18, 1994

[51] Int. Cl.[5] ..... B68B 1/00

[52] U.S. Cl. ..... 54/35; 54/71

[58] Field of Search ..... 54/20, 35, 44.1, 59, 54/71

[56] References Cited

U.S. PATENT DOCUMENTS

| | | | |
|---|---|---|---|
| 120,049 | 10/1871 | Dutton | 54/20 |
| 1,099,823 | 6/1914 | Saxe | 54/20 |
| 4,453,371 | 6/1984 | Abbott-Davies | 54/35 |

FOREIGN PATENT DOCUMENTS

| | | | |
|---|---|---|---|
| 2596744 | 10/1987 | France | 54/71 |

OTHER PUBLICATIONS

Dover Saddlery Magazine, 1993–1994, p. 31.

State Line Tack, Inc., 1993–1994 Annual Discount Catalog, pp. 63–65 and 72–75.

Wiese Equine Supply, 1993 Catalog, pp. 61–67.

*Primary Examiner*—Robert P. Swiatek

*Attorney, Agent, or Firm*—Hovey, Williams, Timmons & Collins

[57] ABSTRACT

An improved breastplate assembly (10) which is adapted for connection with a saddle (12) and serves as a humane training aid to encourage a horse to travel with its head lowered while avoiding injury to the animal in the event of undue upward movement of the horse's head and neck. The breastplate assembly (10) includes a breastplate (14) having a pair of interconnected straps (24, 26) adapted for connection to the saddle (12), together with a depending central strap (16) coupled with the breastplate (14) and extending downwardly for connection with the lower girth strap (22) of saddle (12). The central strap (16) includes an elongated, axially stretchable section (42), which preferably forms the lowermost section of the strap (16). A tiedown strap (18) is secured to the central strap (16) and extends upwardly for coupling with the horse's bridle to provide yieldable, axially stretching of the central strap (16) in response to upward movement of the horse's head.

9 Claims, 1 Drawing Sheet

BREASTPLATE ASSEMBLY WITH ELASTIC TIEDOWN

BACKGROUND OF THE INVENTION

1. Field of the Invention

The present invention is broadly concerned with an improved breastplate assembly for use with otherwise conventional saddle and bridle assemblies, in order to better fit various horses while at the same time providing a more humane training aid having elastic properties which accommodate natural movement of the horse's head. More particularly, the invention pertains to a breastplate assembly including an upper breastplate adapted for connection to a saddle, together with a depending, central strap coupled with the breastplate and extending downwardly therefrom for connection with the saddle girth strap; the central strap includes an elastic, axially stretchable section, preferably as the lower segment of the central strap. An elongated tiedown strap is operably connected with the central strap and extends upwardly for coupling with the horse's bridle. In this fashion, the stretchable section undergoes elastic elongation in response to upward movement of the horse's head during riding.

2. Description of the Prior Art

Breastplates have been used for centuries with saddles in order to prevent the latter from sliding rearwardly on a horse during riding over rough terrain or up steep grades. The breastplate attaches to the front of the saddle on each side of the horse, and a third or central strap is secured to the breastplate and extends downwardly from the base of the horse's neck and between the horse's legs for connection to the girth strap forming a part of the saddle. In addition, it is common to employ a tiedown strap which is attached to the center of the breastplate and which extends upwardly for connection to the horse's bridle. Such a connection may be to the nose ring of the bridle, to the bridle reins, or to any other convenient location adjacent the horse's head. The purpose of the tiedown strap is to keep the horse's head down and thereby enhance control of the horse. That is, a horse will often attempt to raise its head and neck quickly to maintain balance while at speed, and this can be dangerous to the rider. Accordingly, the tiedown strap is used both as a training aid for the horse and to prevent undue lifting of the horse's head and neck.

Prior breastplate assemblies including tiedown straps are deficient in that they present a relatively solid restraint to the horse's natural movements. Indeed, such prior assemblies have been known to injure horses, particularly with animals having a pronounced tendency toward extreme upward movement of the head and neck. Injuries of this type typically occur around the face or nostrils of the horse, and are therefore especially dangerous.

SUMMARY OF THE INVENTION

The present invention overcomes the problems outlined above and provides an improved breastplate assembly adapted for connection with a saddle secured to a horse by means, inter alia, of a lower girth strap. The assembly includes a breastplate having a pair of interconnected breast-engaging straps each presenting a free end adapted for coupling with a saddle. The overall assembly further includes a depending, central strap operably coupled with the breastplate and extending downwardly therefrom, with the end of the central strap remote from the breastplate being adapted for coupling with the lower girth strap of the saddle. Very importantly, the central strap of the assembly includes an elastic, axially stretchable section. An elongated tiedown strap is operably connected with the central strap and extends upwardly for connection with the horse's bridle. In this fashion a yieldable, elastic, axially stretching of the central strap section is provided in response to upward movement of the horse's head.

In preferred forms, the central strap includes an uppermost, substantially non-elastic section coupled with the breastplate, with the elastic axially, stretchable section being secured to the uppermost section adjacent the end of the latter remote from the breastplate. In such a construction, the tiedown strap is secured to the central strap at the region of interconnection between the uppermost and elastic sections thereof.

DETAILED DESCRIPTION OF THE PREFERRED EMBODIMENTS

Figures 1, 2, 3, 4:
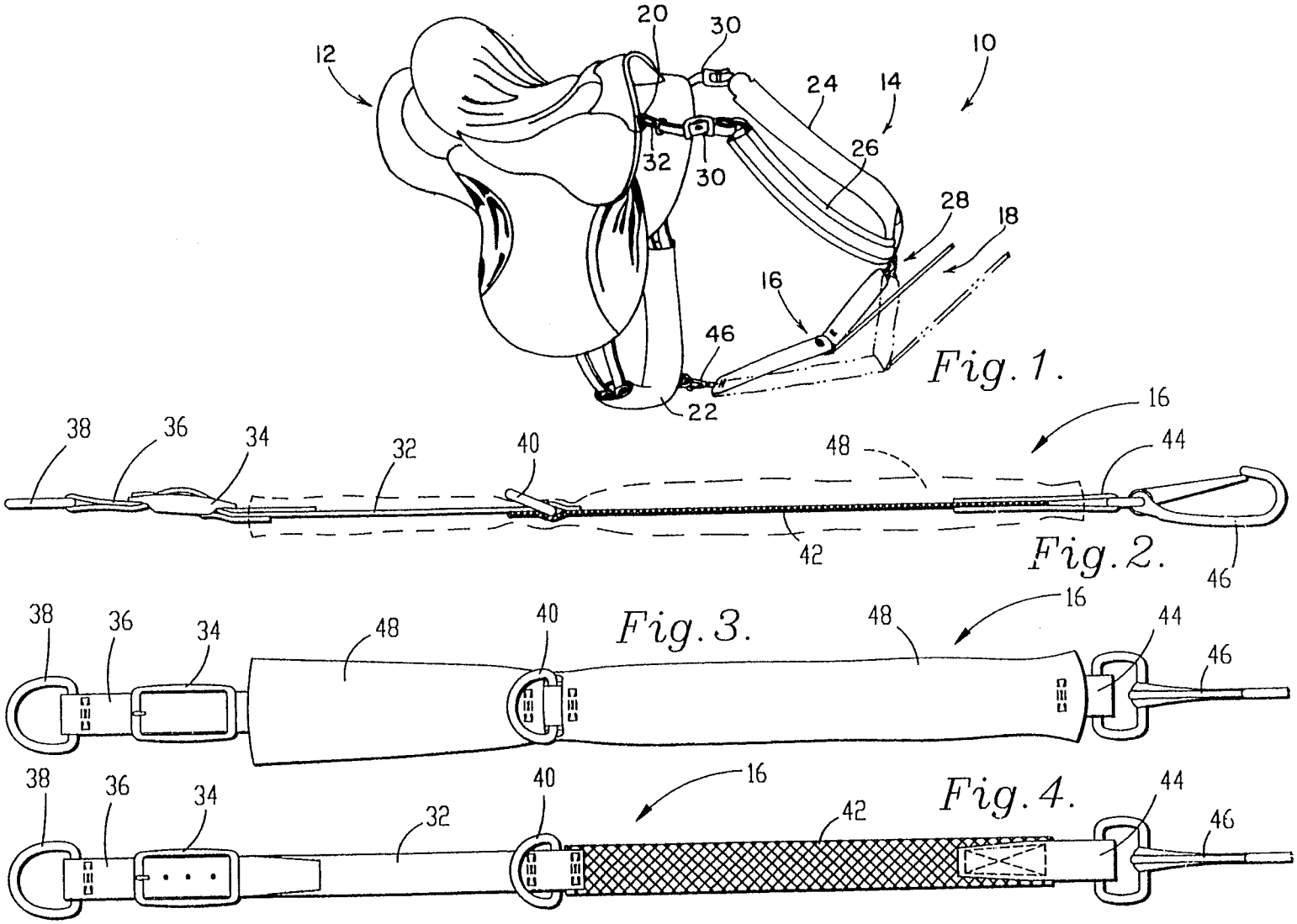
FIG. 1 is a side view of a conventional saddle with the improved breastplate assembly of the invention operably coupled to the saddle, and showing in phantom the axially stretched position of the central strap of the breastplate assembly.
FIG. 2 is a side view of the preferred central strap forming a part of the breastplate assembly, with the outer neoprene rubber sheath of the central strap being depicted in phantom.
FIG. 3 is a plan view of the preferred central strap forming a part of the breastplate assembly.
FIG. 4 is a view similar to that of FIG. 3, but showing the central strap with the outer neoprene rubber sheath removed.

Turning now to the drawings, and particularly FIG. 1, a breastplate assembly 10 is illustrated in its operative position coupled with a conventional saddle 12. Broadly speaking, the assembly 10 includes an uppermost breastplate 14, as well as a depending central strap 16; a tiedown strap 18 is secured to central strap 16 and extends upwardly for connection to a bridle or the like (not shown).

More detailed, the saddle 12 is completely conventional and includes a pair of forward connection rings 20, as well as a lowermost girth strap 22. As those skilled in the art will appreciate, the girth strap 22 provides a means for securing saddle 12 to a horse, whereas the rings 20 permit connection of breastplate 14 to saddle 12 as illustrated.

Breastplate 14 is in the form of first and second strap members 24, 26 which are interconnected adjacent their lower ends to present a central connection region 28. In the form shown, each of the strap members 24, 26 is formed of leather with an inner neoprene rubber sheath which contacts the horse. In addition, the upper end of each of the strap members 24, 26 is equipped with a rearwardly extending, adjustable strap 30 having a releasable connector 32 for coupling to the rings 20 as shown.

Central strap 16 is illustrated in detail in FIGS. 2–4 and includes an uppermost, substantially non-elastic section 32 formed of plastic, leather or some other suitable material. The uppermost section 32 is adjustable by means of buckle 34, which cooperates with an apertured belt 36 for this purpose. The belt 36 is permanently secured to the central region 28 of breastplate 14 through the medium of D-ring 38, which is retained on central region 28 by means of a sewn-in-place leather connector (not shown). An intermediate D-ring 40 is permanently secured to the end of section 32 remote from ring 38.

The overall strap 16 further includes an elastic, axially stretchable section 42, which is permanently affixed to the lower end of section 32 by sewing or any other convenient attachment. In the form depicted, the section 42 is formed from a substantially planar segment of stretchable elastic material. In alternative forms, use can be made of materials such as bungee cord or any suitable elastically stretchable and resilient material; indeed, even a coil spring could be employed if suitably encased within a protective sleeve. Again returning to FIGS. 2–4, it will be seen that the end of section 42 remote from uppermost section 32 includes a leather or plastic connector loop 44 which is affixed by sewing, gluing or any other convenient technique. A snap connector 46 is retained by loop 44 as shown.

In order to provide the most comfortable fit to the horse, the strap 16 is preferably encased within a tubular sheath 48 of soft, non-irritating material such as neoprene rubber.

Tiedown strap 18 is of itself entirely conventional, and is in the form of an elongated leather or synthetic resin strap releasably secured to D-ring 40 of lower strap 16 and extending upwardly for connection to the horse's bridle. In this regard, it will be understood that the bridle connection can be made at any convenient location, such as to the nose ring of the bridle, to the reins, or any other suitable place.

In the use of the breastplate assembly 10, the breastplate 14 is first secured to the rings 20 of the saddle 12, whereupon the central strap 16 is passed between the horse's forward legs and is connected to lower girth strap 22. Tiedown strap 18 is then coupled with D-ring 40 of central strap 16 and to the horse's bridle. During training or normal riding of the horse, the breastplate assembly 10 yieldably accommodates the natural movement of the horse's head and neck, while avoiding any injury to the horse. As a training aid therefore, the assembly 10 gently encourages the horse to travel with its head lowered, and the elasticity of the strap section 42 maintains a steady pull discouraging resistance and rebelliousness from the horse. When the horse does jerk upwardly, the strap section 42 axially stretches as shown in phantom in FIG. 1, in order to accommodate such movement without horse injury. The attachment of the strap 18 midway along the length of central strap 16 causes the strap 16 to not only pull upwardly, but also outwardly and away from the chest of the horse. This is a further safety measure to avoid injury to the horse.

I claim:

1. A breastplate assembly adapted for connection with a saddle secured to a horse by a lower girth strap, there being a bridle assembly operably mounted on the head of said horse, said assembly comprising:

a breastplate including a pair of interconnected breast-engaging straps each presenting a free end adapted for coupling to said saddle;

a depending, central strap operably coupled with said breastplate and extending downwardly therefrom, the end of said central strap remote from said breastplate being adapted for coupling with said lower girth strap, said central strap including an elastic, axially stretchable section; and an elongated tiedown strap operably connected with said central strap and extending upwardly therefrom in order to connect with said bridle assembly for elastic, axial stretching of said central strap section in response to upward movement of the head of said horse.

2. The breastplate assembly of claim 1, said central strap including an uppermost, substantially non-elastic section operably coupled with said breastplate, said elastic, axially stretchable section being secured to said uppermost section adjacent the end of the uppermost section remote from said breastplate.

3. The breastplate assembly of claim 2, said axially stretchable section including a releasable connector adjacent the end thereof remote from said uppermost section for connection of the central strap to said lower girth strap.

4. The breastplate assembly of claim 2, including connection structure adjacent the point of securement between said uppermost section and said axially stretchable section for releasable connection of said tiedown strap to said connection structure.

5. The breastplate assembly of claim 4, said connection structure comprising a D-ring secured to said uppermost sect i on.

6. The breastplate assembly of claim 1, said elastic, axially stretchable section being formed of a substantially planar segment of elastic material.

7. The breastplate assembly of claim 1, said central strap including an outer sheath of soft, rubber-like material extending along the length of the central strap.

8. The breastplate assembly of claim 7, said sheath being formed of neoprene rubber.

9. The breastplate assembly of claim 1, said central strap including structure for selective adjustment of the length thereof.

* * * * *